United States Patent [19]

Freitag et al.

[11] 3,949,333

[45] Apr. 6, 1976

[54] AUXILIARY SWITCH FOR ELECTROMAGNETIC CONTACTOR

[75] Inventors: Lawrence F. Freitag, Bayside; Joseph E. Koziczkowski; Donald V. Zunft, both of Greendale; Glenn W. Schwantes, Sussex, all of Wis.

[73] Assignee: Allen-Bradley Company, Milwaukee, Wis.

[22] Filed: July 12, 1974

[21] Appl. No.: 487,975

[52] U.S. Cl. ..... 335/132; 335/197

[51] Int. Cl.[2] ..... H01H 67/02

[58] Field of Search ..... 335/197, 198, 200, 132; 200/153 LA

[56] References Cited

UNITED STATES PATENTS

| | | | |
|---|---|---|---|
| 1,911,611 | 5/1933 | Douglas | 200/153 LA |
| 3,249,725 | 5/1966 | Hutt et al. | 200/153 LA |
| 3,382,469 | 5/1968 | Conner | 335/132 X |
| 3,388,353 | 6/1968 | Isler | 335/132 |
| 3,562,464 | 2/1971 | Vollum et al. | 200/153 LA |

*Primary Examiner*—George Harris
*Attorney, Agent, or Firm*—Quarles & Brady

[57] ABSTRACT

One or more sets of auxiliary contacts are contained within a cartridge which mounts to the side of an electromagnetic contactor. The cartridge snaps into position and is firmly supported at each of its ends. A cam member slidably mounts to the cartridge and couples to the contactor actuator. It includes a sloping cam surface which engages a cam follower pivotally mounted within the cartridge and translates the sliding motion of the contactor actuator into a pivotal motion which operates the auxiliary contacts.

7 Claims, 8 Drawing Figures

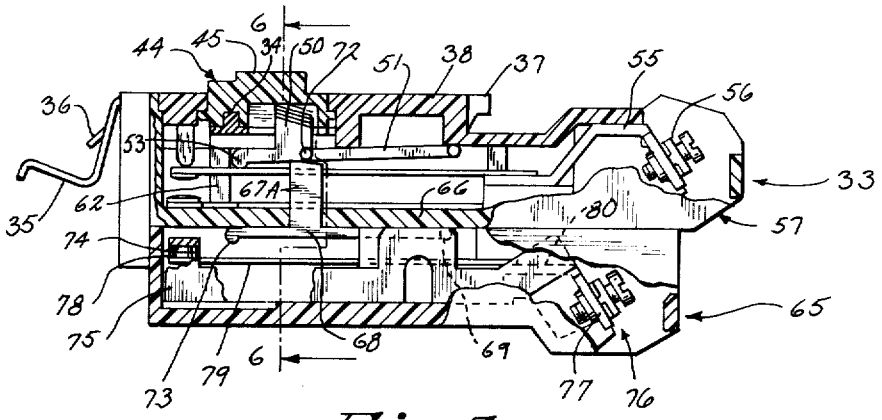
Fig.5
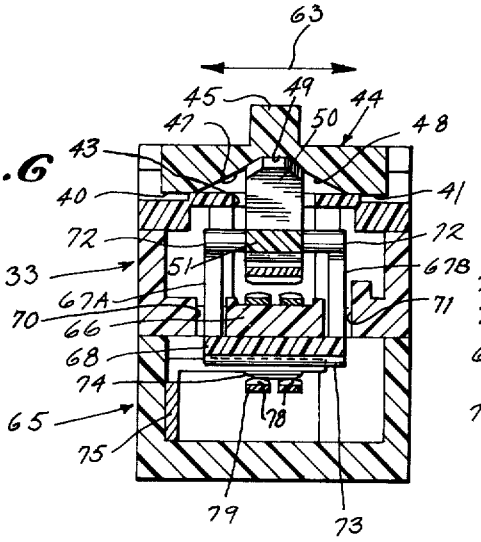
Fig.6
Fig.8
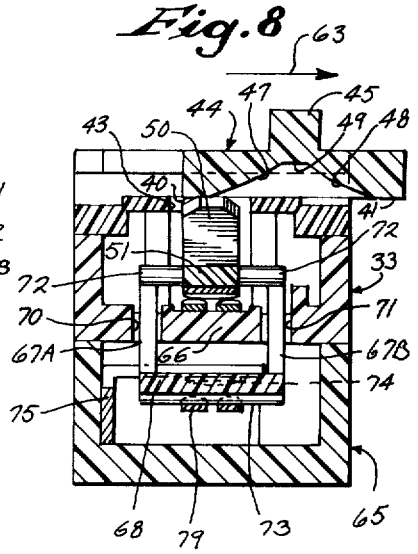
Fig.7
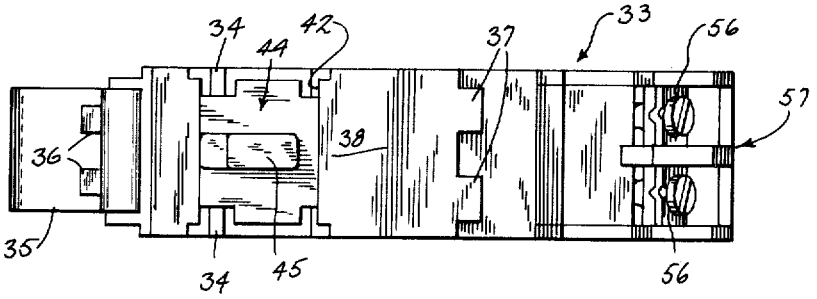

AUXILIARY SWITCH FOR ELECTROMAGNETIC CONTACTOR

BACKGROUND OF THE INVENTION

The field of the invention is electrical switches, and more specifically, electromagnetically operated switches such as relays and line contactors.

Contactors such as that disclosed in U.S. Pat. No. 3,134,869 issued to Leland Lawrence on May 26, 1964, are commonly employed to start and stop electric motors. In such motor starters, the contactor not only opens and closes the main contacts which carry power to the motor, but it also opens and closes auxiliary contacts which connect into control circuits associated with the motor starter. Because such auxiliary contacts do not carry large currents, they are considerably smaller than the main line contacts and are enclosed in cartridges which fasten to the contactor. The auxiliary contacts are coupled to the actuator on the contactor and are spring biased to either a normally opened or normally closed position. The contactor actuator operates the auxiliary contacts when the contactor is energized, and the actuator works against this spring force. The auxiliary contacts thus add additional loading on the electromagnet which operates the actuator.

In addition to the loading which such auxiliary contacts place on the electromagnet, the auxiliary contact cartridges increase the outer dimensions of the contactor. For example, in contactors such as that shown in U.S. Pat. No. 2,919,327 issued on Dec. 29, 1959 to Kuhn et al., the auxiliary contact cartridge extends outward from the contactor increasing its outer dimensions. Because contactors are generally confined in enclosures with other electrical equipment, it is desirable to keep the size of the contactor to a minimum.

SUMMARY OF THE INVENTION

The present invention relates to an auxiliary contact cartridge which is mounted alongside the actuator of an electrical switch, and more particularly it relates to an electrical switch in which the contact cartridge includes a cam mechanism which couples with the actuator and operates the auxiliary movable contact in a direction substantially perpendicular to the direction of motion of the actuator.

It is a general object of the invention to minimize the loading which the auxiliary contacts impose on an electromagnetically operated actuator. The cam mechanism in the auxiliary contact cartridge couples to the actuator when the cartridge is snapped into position. It includes a cam member which has a sloping cam surface that cooperates with a cam follower element to translate the sliding motion of the actuator along its actuator axis into a substantially perpendicular motion. The motion of the cam follower element opposes the bias force which maintains the auxiliary contacts in their normally opened or normally closed position. The cam member also includes a level portion which merges with the sloping cam surface and which locks the auxiliary contacts in their actuated position. Thus, when the electromagnet is energized and the actuator member slides along its axis of motion to operate the main line contacts, the bias force generated by the auxiliary contacts is overcome during the initial portion of the actuator stroke when the cam follower element engages the sloping cam surface, and the auxiliary contacts are then locked in their actuated position by the level portion of the cam member during the latter portion of the actuator stroke. The electromagnet may, therefore, be designed to meet the maximum loading of the main contact bias springs because the loading imposed by the auxiliary contacts occurs only during the initial portion of the actuator stroke when the main contact loading is minimal.

Another general object of the invention is to provide an auxiliary switch cartridge and a means of easily and securely mounting it to a contactor. The contactor includes a base which defines a guideway in which the actuator slides. Posts extend forward from the base to provide support for a stationary cover which retains the actuator in the guideway. The auxiliary contact cartridge is mounted alongside the movable actuator by fastening it to the stationary base and cover. Although the cartridge spans a considerable distance between the base and cover, it is securely fastened at both of its ends and the resulting length of the cartridge is used to advantage.

Another object of the invention is to provide a universal auxiliary contact cartridge which may be mounted to any one of a number of electrical switching devices.

Another object of the invention is to provide a universal auxiliary contact cartridge which may be mounted at any one of several locations on the contactor. A number of slots, or locations, are provided to receive and hold an auxiliary contact cartridge between the base and cover portions of the contactor. These slots are located to either side of the movable actuator member, and to allow the cartridges to be used in all of the slots, the cam mechanism in each is symmetrically shaped so that it may be operated in either direction from a centered, or unactuated position.

Another object of the invention is to provide an electromagnetically operated contactor to which auxiliary contact cartridges may be mounted without substantially increasing its outer dimensions. The auxiliary contact cartridges are relatively long and slender and are mounted directly beneath the structure which encloses the main line contacts. The width and depth of the contactor is determined primarily by the size of the line contact enclosure and the auxiliary contact cartridges are mounted to a narrow portion of the contactor, to either side of the electromagnet assembly. The auxiliary contact cartridges thus do not extend the outer dimensions of the contactor, but instead, "fill in" the rectangular volume already required by the basic contactor elements.

A specific object of the invention is to minimize the interaction between the operation of the main line contacts and the operation of the auxiliary contacts. The auxiliary contacts operate in a plane which is perpendicular to the motion of the actuator and attached main line contacts. In the event the main line contacts "bounce", for example, the generated forces do not affect the auxiliary contacts because of their perpendicular orientation.

Another specific object of the invention is to provide an auxiliary contact cartridge which is easily connected when the contactor is mounted in a crowded cabinet. The terminal structure on each cartridge faces forward when the cartridge is mounted to the contactor, thus allowing easy access even though equipment is located immediately alongside.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

BRIEF DESCRIPTION OF THE DRAWINGS

FIG. 5 is a view in cross section taken through the double auxiliary contact cartridge in FIG. 1, FIG. 6 is a view in cross section of the double auxiliary contact cartridge in FIG. 5 taken along the plane 6—6, FIG. 7 is a side view of the double auxiliary contact cartridge in FIG. 1, and FIG. 8 is a view in cross section of the double auxiliary contact cartridge in FIG. 6 in its actuated state.

DESCRIPTION OF THE PREFERRED EMBODIMENT

Figure 1:
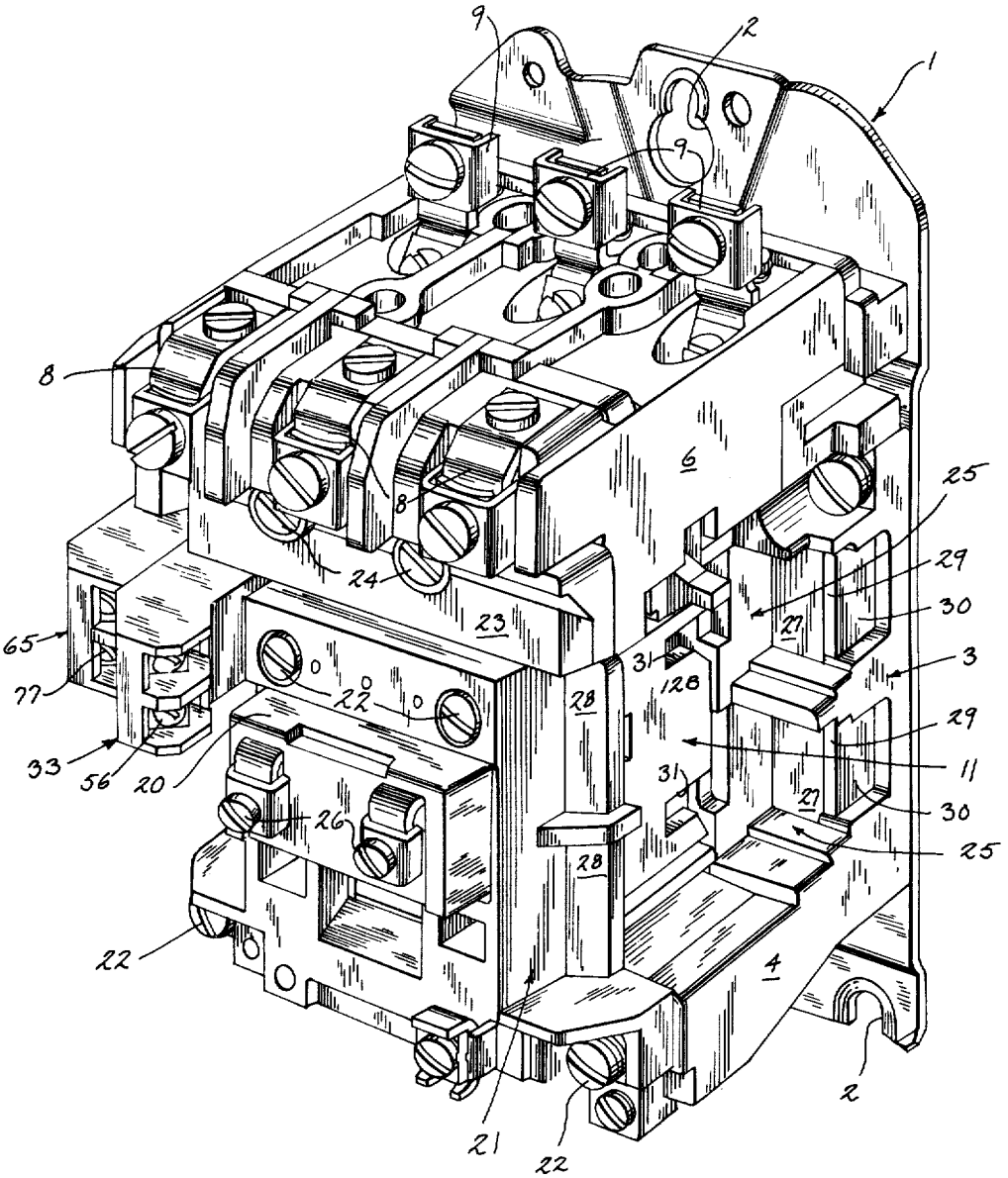
FIG. 1 is a perspective view of the invented contactor with an attached double auxiliary contact cartridge.
Figure 2:
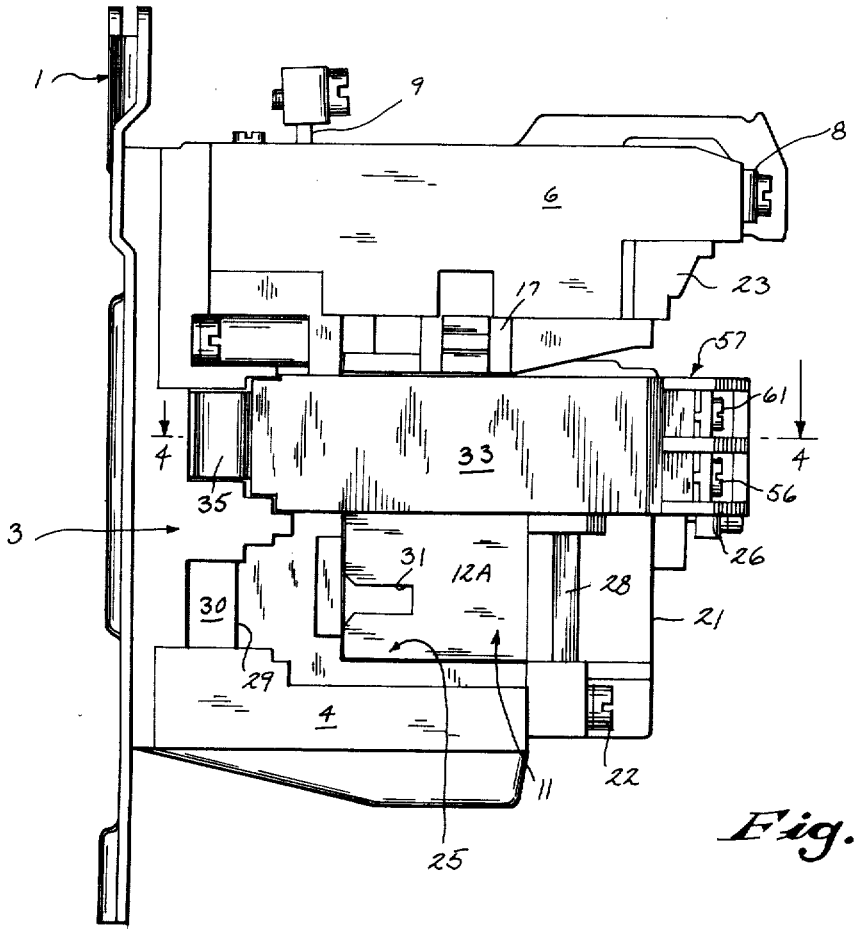
FIG. 2 is a side elevation view of the contactor in FIG. 1 with an attached single auxiliary contact cartridge.
Figure 3:
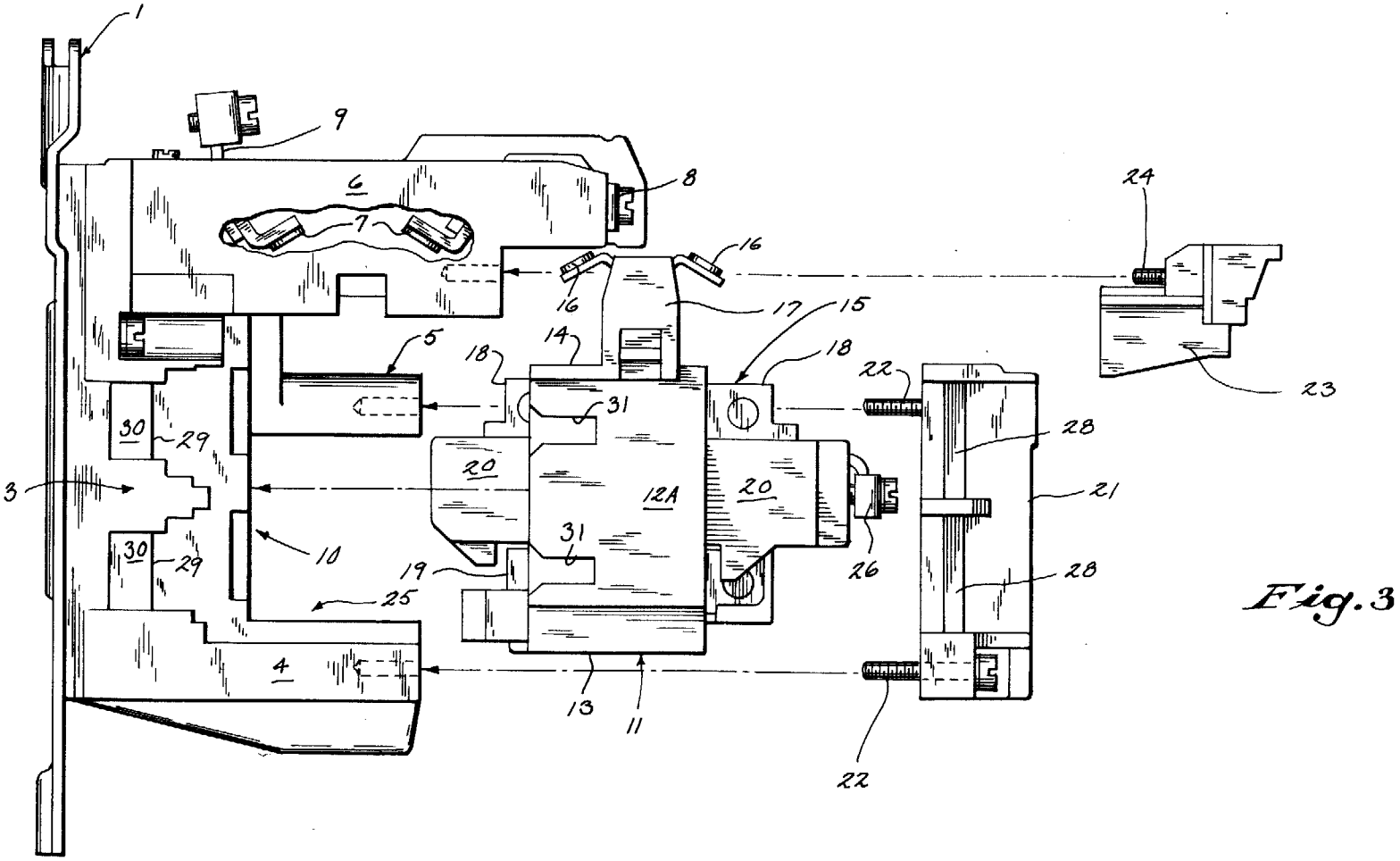
FIG. 3 is an exploded view with parts cut away of the contactor shown in FIG. 1.

Referring particularly to FIGS. 1–3, the contactor includes a sheet metal mounting plate 1 having a set of apertures 2 for mounting on a panel or in an enclosure. A base structure 3 molded from a thermosetting polyester insulating material is fastened to the mounting plate 1 and extends forward therefrom to provide the framework for the contactor. The base 3 includes an integrally molded terminal post portion 4 which extends forward from its lower end, a pair of integrally molded support posts 5 which extend forward from its mid section, and an integrally molded line contact enclosure 6 which extends forward from the upper end of the base 3. The contact enclosure 6 mounts three sets of stationary line contacts 7 which connect to three corresponding input terminals 8 and three corresponding output terminals 9. The contacts 7 and terminals 8 and 9 form a three-phase circuit in which the conductivity is controlled by the operation of the contactor.

The base 3 forms a guideway indicated generally at 10 which slidably mounts an actuator 11 for operation along a vertical actuator axis. The actuator 11 is formed from molded polyester and includes a pair of spaced side walls **12*a* and 12*b* which are connected together by a bottom wall 13 and a top wall 14. The actuator 11 encloses an electromagnet 15 between the side walls 12*a* and 12*b* and it supports three sets of movable main contacts 16 which are mounted to an integrally formed support 17 that extends upward from the top wall 14. The electromagnet 15 includes a magnetic circuit which is comprised of a stationary yoke 18 and a movable armature 19. The electromagnet 15 also includes a stationary coil structure 20 which has two openings (not shown in the drawings) that surround the legs (not shown in the drawings) of the yoke 18. Electrical power is supplied to the coil 20 through a pair of input control terminals 26. One end of the stationary yoke 18 and coil structure 20 is received by the base 3 and the other end is received by a cover 21 which is fastened to the terminal post 4 and support posts 5 by a set of four screws 22. The cover 21 is formed of molded polyester and it includes a central opening 23 through which the coil structure 20 extends. A retainer element 23 formed of a molded polyester is fastened to the contact enclosure 6 by a pair of screws 24. It serves to fully enclose the main contacts 7 and 16**.

The electromagnet armature 19 is attached to the bottom wall 13 of the actuator 11 and the combined elements slide along the actuator axis between a lower, or deenergized, position and an upper, or energized, position. During this stroke, the movable main contacts 16 are carried by the armature 11 into contact with the stationary contacts 7, and during the remainder of the stroke, bias springs (not shown in the drawings) are compressed to provide contact pressure. During the initial portion of the stroke, therefore, the force generated by the electromagnet 15 need only overcome the dead weight of the armature structure and the frictional forces associated with the sliding motion. However, after contact is made the force rapidly rises. For a more detailed description of the actuator 11 and associated electromagnet 15, reference is made to U.S. Pat. No. 3,134,869 issued to L. E. Lawrence on May 26, 1964 and entitled "Electromagnet Assembly With Interfitting Parts".

As shown best in FIGS. 1–4, two positions, or slots 25 are provided on each side of the contactor for mounting auxiliary contact cartridges. Each of these slots is identically formed and the following description with reference numbers applies to each. Each slot is located alongside the actuator 11 and its back is bounded in part by one of the actuator side walls **12*a* or 12*b*. Referring particularly to FIG. 1, the bottom of each auxiliary contact cartridge position is defined by a ledge 27 which is formed in the base 3 and the forward end of each slot 25 is defined by an overhang 28 which is integrally formed on the cover 21. A lip 29 is formed along the outboard edge of each ledge 27 and an inset 30 is formed on the face of the base 3 immediately adjacent thereto. Openings 31 are formed in the side walls 12*a* and 12*b* of the actuator 11, one being associated with each of the auxiliary contact cartridge slots 25. Each opening 31 is rectangular in shape and is centered on a horizontal plane which extends through the middle of its associated slot 25 when the actuator 11 is in its deenergized position. Each opening 31 translates upward, off center, when the electromagnet 15 is energized and the actuator 11** slides upward.

Figure 4:
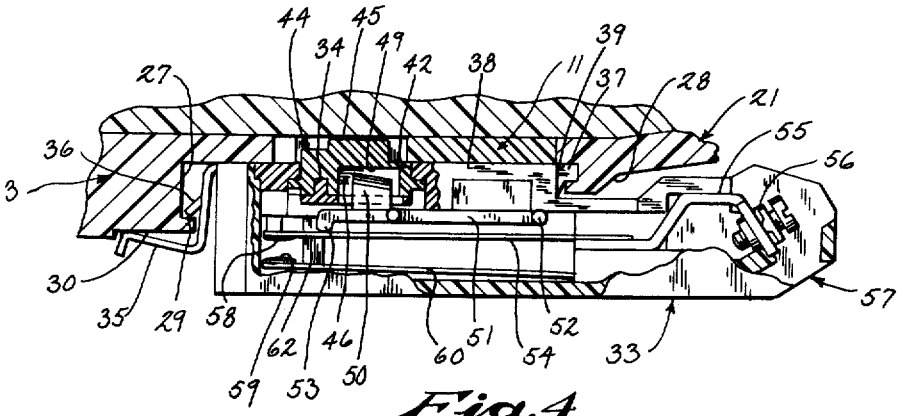
FIG. 4 is a view in cross section of the single auxiliary contact cartridge in FIG. 2 taken along the plane 4—4.

As shown best in FIGS. 2, 4 and 7, an auxiliary contact cartridge 33 fits into one of the slots 25 and is rigidly retained alongside the actuator 11 by the contactor base 3 and cover 21. As will be described in more detail hereinafter, the cartridges 33 are formed of molded thermoplastic polyester parts which form an enclosure for one or more sets of auxiliary contacts. The portions of the enclosure on each cartridge which interact with the contactor are identical in structure despite the number and nature of the contacts contained therein. More specifically, a metallic clasp 35 is fastened to the bottom end of the cartridge 33 and includes a pair of ears 36 which engage the backside of the lip 29 in a slot 25. The clasp 35 wraps around the lip 29 and extends into the inset 30 on the face of the contactor base 3. A pair of tabs 37 are integrally formed on a back wall 38 of each cartridge 33 and these tabs 37 are received by a pair of recesses 39 which are formed on the underside of the overhang 28. The cartridge 33 is fastened to the contactor by guiding these tabs 37 into the recesses 39 and then pressing the bottom end of the cartridge 33 into position. The clasp 35 is biased to spring away from the bottom end of the cartridge 33, and when pressed into position, its ears 36 snap into position behind the lip 29 to lock the cartridge 33 in place. To remove a cartridge 33, the screws 22 must be loosened and the cover 21 lifted slightly to free the tabs 37.

Referring to FIGS. 4–8, the auxiliary contact cartridges 33 each contain either one set or two sets of contacts. Regardless of the number and nature of the contacts in each cartridge 33, however, the structure for coupling the cartridge 33 to the contactor actuator 11 is identical. More specifically, each cartridge 33 has a channel 42 formed in its back wall 38 which extends across its entire width and which includes a guide rail 34. A cam member 44 is slidably mounted in the channel 42 and includes a rectangular shaped coupling element 45 which extends outward from the back wall 38 of the contact cartridge 33. The coupling element 45 fits within the opening 31 in the actuator 11 when the cartridge 33 is inserted in one of the slots 25. A cam surface 46 is also formed on the cam member 44 and it communicates with the interior of the cartridge 33 through an opening 43 located within the channel 42. As shown best in FIG. 6, the cam surface 46 includes a pair of opposing sloped surfaces 47 and 48 which extend away from a level center portion 49 and merge into laterally spaced, level portions 40 and 41.

Contained within the cartridge 33 is a cam follower 50. The cam follower 50 is integrally formed to an arm 51 which is pivotally mounted to the framework of the cartridge 33 by an integrally formed shaft 52. The pivotal axis of the arm 51 and associated cam follower 50 is parallel to the direction in which the cam member 44 slides, and thus when the cartridge 33 is mounted to the contactor, this pivotal axis is substantially parallel to the actuator axis.

An operating end 53 is also formed on the pivot arm 51. The operating end 53 engages a movable contact arm 54 which is welded to a brass bus 55 that is secured to the cartridge framework. The movable contact arm 54 is made of bryllium copper and it provides a spring bias force that supports the arm 51 and retains its associated cam follower 50 in contact with the cam surface 46. A movable contact terminal 56 is formed on the end of the bus 55 and is disposed within a terminal structure 57 which is formed at the forward end of the cartridge 33. The movable contact arm 54 supports a movable contact 58 on its outer end which faces a stationary contact 59 that is fastened to the outer end of a stationary contact arm 60. The contact arm 60 is also made of bryllium copper and its inner end is welded to a bus (not shown in the drawings) which is anchored to the framework of the cartridge 33 and electrically connected to a terminal 61 disposed within the terminal structure 57. The stationary contact arm 60 is also sprung toward the cam member 44 to provide contact force, but it is retained from substantial motion by a stop 62 which is integrally formed to the cartridge framework.

Referring particularly to FIGS. 6 and 8, when the contactor is de-energized, the cam member 44 is centered about a plane which extends through the middle of the switch cartridge 33 and the cam follower 50 extends through the opening 43 in the cartridge back wall 38 and engages the cam member center portion 49. In this deactuated position, the contacts 58 and 59 are open. When the contactor is energized, its actuator 11 slides along the actuator axis indicated by the arrow 63, and the cam member 44 is translated away from its centered position. The cam follower 50 rides over one of the sloped surfaces 47 or 48 during this translation and is pivoted about its shaft 52 towards the interior of the switch cartridge 33. As a result, the operating end 53 of the arm 51 depresses the movable contact arm 54 and closes the contacts 58 and 59. The spacing of the contacts 58 and 59 and the lateral extent and depth of the sloped surfaces 47 and 48 are such that when the cam follower 50 approaches the level portions 40 and 41 on the cam surface 46, the contacts 58 and 59 are firmly closed. The bias force which is generated by the movable contact arm 54 is translated by the cam follower 50 and cam member 44 to oppose the motion of the actuator 11 when the cam follower 50 bears against the slopes portion 47 or 48. However, when the cam follower 50 reaches the level portion 40 or 41, the auxiliary contacts in the switch cartridge 33 are locked in their actuated position and the only force which must be overcome by the actuator 11 is the frictional force between the cam member 44 and the cam follower 50. Therefore, the force necessary to operate the auxiliary contacts in the cartridge 33 reaches a maximum during the early portion of the actuator stroke and decreases to virtually zero at the end of the stroke.

Referring particularly to FIGS. 5, 6 and 7, a double switch cartridge 33 is formed by mounting a second section 65 to the front wall 66 of the cartridge 33. Although the detailed construction of the framework of the second section 65 is different, the principal operating elements contained therein are substantially the same as those described above. More specifically, a second cam follower 67 is integrally formed to a second arm 68 which in turn is pivotally mounted to the framework of the second section 65 by a shaft 69. The second cam follower 67 is bifurcated to form two sections **67*a* and 67*b* which extend through opening 70 and 71 in the front wall 66 and engage a cross piece 72 which is integrally formed on the arm 51. A smooth operating end 73 is formed on the movable end of the second arm 68 and when the cam mechanism on the switch cartridge 33 is operated to pivot the first arm 51 about its shaft 52, the second arm 68 pivots away from the front wall 66 about its shaft 69. A stationary contact 74 is contained within the second section 65 and is securely mounted to the framework by a bus 75 which extends along one wall of the section 65. The bus 75 not only supports the stationary contact 74, but is also provides electrical connection between the stationary contact 74 and a stationary contact terminal (not shown in the drawings) disposed within a terminal structure 76. A movable contact 78 is also disposed within the second section 65 and is held in normally closed contact with the stationary contact 74 by a movable contact arm 79. The movable contact arm 79 is made of bryllium copper and is welded to a bus 80 which securely fastens to the framework of the second section 65 and provides electrical connection with a movable contact terminal 81. The movable contact arm 79 is sprung to bias the movable contact 78 against the stationary contact 74 in a normally closed position. When the operating end 73 of the second arm 68** pivots away from the front wall 66, it engages the movable contact arm 79 and opens the contacts 74 and 78.

It should be apparent that the auxiliary contact cartridges have a relatively long, slender shape and they do not appreciably increase the outer dimensions of the contactor. Instead, they fill a volume alongside the contractor electromagnet directly beneath the line contact enclosure. Also, an advantage of the particular contact structures shown and described herein is the longer switch life obtained by mounting the movable contact on the end of a relatively long movable contact arm in which bending is minimized. This is attributable in part to the position and manner in which the contact cartridges 33 are mounted to the contactor.

It can be appreciated that a number of variations can be made in the preferred embodiments described herein without departing from the spirit of the invention. For example, either normally opened or normally closed contact structures can be used in the single contact cartridge or either normally opened or normally closed contact structures can be used in either of the two sections of a double switch cartridge. Also, the auxiliary contact cartridges may be attached to other types and sizes of actuating devices which include properly dimensioned slots as described herein.

It should also be apparent that the flexibility provided by the present invention allows variations in the cam structure. For example, the specific means for coupling the cam element to the actuator can be altered and the specific means for operating the movable contact in response to the motion of the cam follower can be altered. Although particularly efficient use is made of available space by mounting the cam follower to pivot in a plane perpendicular to the actuator axis, it should be apparent to those skilled in the art that other arrangements for coupling the motion of the cam follower to the movable contact in the cartridge can be made. Also, the symmetrical cam surface provided in the preferred embodiments described herein allows the auxiliary contact cartridge to be mounted on either side of the contractor. This symmetry is not required if, for example, distinct left side and right side cartridges are provided.

We claim:

1. An electromagnetically operated switch the combination comprising:

a base having posts which extend forward from a guideway;

a contact enclosure connected to the base and extending forward therefrom at one of its ends, said enclosure including a set of stationary contacts;

an electromagnet supported by said base and including a stationary yoke and a movable armature;

an actuator connected to said armature and mounted to slide in said guideway along an actuator axis when said electromagnet is operated;

movable contacts connected to said actuator for movement along said actuator axis between an opened position and a closed position in which they engage stationary contacts;

a cover fastened to said posts and disposed forward of said actuator; and an auxiliary contact cartridge mounted to said base and cover alongside said movable actuator, said cartridge including an auxiliary movable contact and a cam member which is slidably mounted to said auxiliary contact cartridge and which operates in combination witht a cam follower to translate the sliding motion of said actuator along said actuator axis to a motion which is substantially perpendicular thereto and to thereby operate said auxiliary movable contact.

2. The electromagnetically operated switch as recited in claim 1 in which a plurality of mounting slots are provided along each side of said actuator by an overhang formed on said cover and an opposing ledge formed on said base, and said auxiliary contact carrtridge is mounted in one of said slots.

3. The electromagnetically operated switch as recited in claim 2 which includes means for rigidly retaining said auxiliary contact cartridge to the overhang on said cover and which includes a clasp fastened to said auxiliary contact cartridge and biased to provide a snap action connection between said auxiliary contact cartridge and the ledge of said one slot.

4. In an electrical switch, the combination comprising;

an actuator operable to slide along an actuator axis in a stroke between an unactuated and an actuated position;

an enclosed contact cartridge mounted alongside said actuator and including a cam element which couples with said actuator and which is slidably mounted to the cartridge framework for motion along said actuator axis, said cam element including a cam surface which communicates with the interior of said cartridge;

a cam follower contained within said cartridge and pivotally mounted to said cartridge framework for engagement with said cam surface, said cam follower being operable to pivot about an axis substantially parallel to said actuator axis in response to the sliding motion of said cam element; and a movable contact mounted in said cartridge for operation by said cam follower between an opened and closed position.

5. The detailed switch as recited in claim 4 in which said cam surface has a sloped portion which operates said cam follower during the initial portion of the actuator stroke and a level portion which locks said cam follower in its actuated position during the final portion of the actuator stroke.

6. The electrical switch as recited in claim 5 in which said cam surface includes a second sloped portion identical to the first and symmetrical therewith about a center line, and a second level portion identical to the first and symmetrical therewith about said center line, such that said contact cartridge may be mounted on either side of said actuator.

7. In an electrical switch the combination comprising:

a base;

an actuator mounted to said base for motion about an actuator axis;

an enclosed contact cartridge mounted to said base and including a cam element which couples with said actuator and which is slidably mounted to the cartridge framework for motion along said actuator axis, said cam element including a cam surface which communicates with the interior of said cartridge;

a cam follower contained within said cartridge and in engagement with said cam surface, said cam follower being operable to move in a plane substantially perpendicular to said actuator axis in response to the sliding motion of said cam element;

and a movable contact mounted in said cartridge and the engagement with said cam follower, said movable contact being responsive to the motion of said cam follower to move between an opened and closed position.

* * * * *